US006083104A

United States Patent [19]

Choi

[11] Patent Number: 6,083,104

[45] Date of Patent: Jul. 4, 2000

[54] PROGRAMMABLE TOY WITH AN INDEPENDENT GAME CARTRIDGE

[75] Inventor: Kei Fung Choi, Hong Kong, The Hong Kong Special Administrative Region of the People's Republic of China

[73] Assignee: Silverlit Toys (U.S.A.), Inc., City of Industry, Calif.

[21] Appl. No.: 09/223,958

[22] Filed: Dec. 31, 1998

Related U.S. Application Data

[63] Continuation-in-part of application No. 09/008,378, Jan. 16, 1998, Pat. No. 5,908,345, and a continuation-in-part of application No. 09/140,060, Aug. 12, 1998.

[51] Int. Cl.[7] ..... A63F 9/24

[52] U.S. Cl. ..... 463/6; 463/46; 463/44; 446/436; 446/460

[58] Field of Search ..... 446/436, 437, 446/454, 457, 460, 468; 463/43–46, 47, 6; 273/148 B

[56] References Cited

U.S. PATENT DOCUMENTS

| | | |
|---|---|---|
| 3,840,086 | 10/1974 | Burton . |
| 4,198,620 | 4/1980 | Vogt et al. . |
| 4,201,012 | 5/1980 | Marshall . |
| 4,208,654 | 6/1980 | Vogt et al. . |
| 4,390,877 | 6/1983 | Curran . |
| 4,480,401 | 11/1984 | Matsushiro . |
| 4,654,659 | 3/1987 | Kubo . |
| 4,662,854 | 5/1987 | Fang . |
| 4,712,184 | 12/1987 | Haugerud . |
| 4,754,133 | 6/1988 | Bleich . |
| 4,767,376 | 8/1988 | Hanzawa . |
| 4,813,907 | 3/1989 | Rissman et al. . |
| 5,100,153 | 3/1992 | Welte . |
| 5,147,237 | 9/1992 | Kwan et al. . |
| 5,334,075 | 8/1994 | Kakizaki et al. . |
| 5,474,486 | 12/1995 | Chilton et al. . |
| 5,481,257 | 1/1996 | Brubaker et al. . |
| 5,697,829 | 12/1997 | Chainani et al. . |
| 5,723,855 | 3/1998 | Oh et al. . |

FOREIGN PATENT DOCUMENTS 2259915 12/1972 Germany .

OTHER PUBLICATIONS

"OWI expands its line of do–it–yourself multi–market robots"; The Toy Book; Feb. 1991; p. 94.

"Heath's HERO–1 Robot"; BYTE Publications Inc.; Jan. 1983; pp 86–96.

"Buddy L Ready, Set, Go", 1993, SLM, Inc. (copy of photographs).

"Big Trak", 1979, Milton Bradley Company (copy of photographs).

U.S. Copyright No. 395–138; Registered Mar. 24, 1997.

*Primary Examiner*—Jessica J. Harrison
*Assistant Examiner*—Corbett B Coburn
*Attorney, Agent, or Firm*—Oppenheimer, Wolff & Donnelly LLP

[57] ABSTRACT

A programmable device such as a toy or novelty item wherein there is a body. There is also a keyboard on an independent cartridge with a microprocessor which can be activated by a user to selectively cooperate with the body and set up any one of multiple different motions of the toy. Sounds and lights in the body can be activated to coordinate with the movement. The toy can be a car or other device capable of moving in the environment. The keyboard on the cartridge can also be used independently to play a game programmed with the microprocessor in the cartridge, the game being independent of the body. The game can relate to issues of vehicle driving. An alarm clock feature can be included in the cartridge.

32 Claims, 12 Drawing Sheets

| Main Manual Icon Name | Status Icon Name | Icon Name |
|---|---|---|
| PROGRAMMABLE DRIVE MODE | LIGHT BULB ~ ON | SCORE ICON |
| GAME MODE | BUMPER ~ ON | STEP ICON |
| ON LINE DRIVE MODE | SPEAKER (CAR) ~ ON | AM ICON |
| ALARM SET MODE | ALARM ~ ON | PM ICON |
| SETTING MODE | M MEMORY | DISPLAY SCORE AND TIME |
| | FUEL | |

PROGRAMMABLE TOY WITH AN INDEPENDENT GAME CARTRIDGE

CROSS-REFERENCE TO RELATED APPLICATIONS

This invention relates to application Ser. No. 09/008,378, now U.S. Pat. No. 5,908,345 filed Jan. 16, 1998, entitled PROGRAMMABLE TOY, and to application Ser. No. 09/140,060, pending new application filed Aug. 12, 1998, entitled PROGRAMMABLE TOY AND GAME. The contents of those applications are incorporated by reference herein. This application is a continuation in part of the of these applications.

BACKGROUND OF THE INVENTION

This invention relates to a programmable system for enabling an object, preferably a toy or novelty item, to perform a series of movable actions chosen by a user. Additionally the invention is directed to a toy usable as a game where there is an independent game cartridge.

Many toys or novelty items are available in the market which can perform different actions instructed by a player through the use of a remote control device. Typically the use of the remote control device results in a specific action of a toy object, for instance a vehicle. The remote control systems are either infrared, or radio controlled and can only be used to instruct the vehicle to perform individual or separate actions. These kinds of actions can be associated with movement of the toy.

There are also available many different kinds of games which are relatively stationary and which constitute novelty games, and games of skill in the hands of the operator.

Having a variable programmable toy or novelty item which has the features of a movable toy, which also has elements of a novelty game, and which can be used as an independent game with an independent game cartridge would have distinct advantages and benefits in the consumer market.

The invention is directed to overcoming the limitations of existing toys, novelty items and games.

SUMMARY OF THE INVENTION

The invention provides for an interactive programming system for a toy or novelty item. A user, by pressing appropriate keypad buttons on an independent cartridge can program or instruct an object to perform a series of preset actions. These actions are preset in that different keys are programmed in a first mode when the cartridge is operable with a movable toy to operate or effect different movable actions of the toy or novelty item. In the first mode, namely the mode associated with the vehicle, the cartridge is either plugged into the vehicle or is a remote control device connected with the vehicle preferably through infrared signals.

Additionally, in a second mode when the cartridge is independent of the movable toy, further programming enables the cartridge to act as a novelty game which is self contained in the cartridge.

In either mode the operation can, preferably, be accompanied by selected sound effects and light reactions. The novelty game in the second mode is preferably related to driving features associated with the movable toy. Additionally, there can be games in the cartridge independent of features associated with the movable toy.

According to the invention the programmable toy includes a body which has one or more motors for actuating a motion generator which can be in the form of wheels or other devices. In a first mode the cartridge is plugged into a slot in the body and this can cause the body to move through the surrounding environment in response to a program in the cartridge which activates motors in the body. The keypad operates a series of control switches for operation by the user of the toy in a second mode, usually independently of the body. The switches are connected to a programmed or programmable microprocessor for translating the received signals from the switches into control signals.

In the first mode, the mode associated with moving the body, the signals are for operating the motor. The body includes means for receiving the signals, preferably infrared signals from the cartridge. The motor can thereby be caused to activate the body in different selected directions according to the action of the motor on the motive generator.

On the cartridge, there is a multipurpose indicator or display device, preferably, in the form a series of light emitting diodes (LEDs) arranged in a predetermined manner and/or an LCD to indicate to a user which of a selected program is functional in the first mode of operation or the second mode of operation. This indicator is a visually responsive device. The body can also have visual indicators.

In the second mode, selected switches operate through a selected program to activate the LEDs and/or LCDs according to the choices and/or skill exhibited by the operator in activating one or more games. One or more of the LEDs and/or LCDs can act to indicate one or more selected goals which an operator needs to reach by using the switches appropriately. In the second mode, the body is non-functional to effect motion of the body on a surface. Rather, the body is non-functional, and the game is an independent hand-held cartridge electronic game, operable as the operator activates the switches on the cartridge and plays a game loaded into the cartridge. The game program is part of the microprocessor.

In a preferred form of the invention there is a microprocessor which includes a memory function with which predetermined instructions for action and sound effects can be stored for operation in the first and/or second modes. The activities and objects to perform the action and sound effects are determined as selected by the user. The microprocessor operates in the first mode to move the movable toy through the motive means and, in the second mode, to permit playing the game with the visual display. The programming system is driven by an integrated circuit chip which is responsive to the different keys on the cartridge keypad.

The toy comprises in a first form a motorized programmable car. By pressing the appropriated keypad buttons mounted on the exterior of the cartridge, the operator programs the action of the vehicle. The display panel on the cartridge also creates a movement pattern appropriately for the action of the car when operating in the first mode, and matching the same pace of operation in the first mode. The integrated circuit chip is responsive to the different keys that drives the programmable system, of the toy in its first mode.

In the second mode of the toy, the cartridge with its microprocessor and display is responsive game of skill in the nature of a hand-held game. These games include preferably multiple skill games set in multiple different levels. There are different displays to represent different games. One game, when related to a vehicle, is such that it relates to driving of a car in a racing game mode or a game of trying to cross a road where vehicles travel on the road.

The invention is further described with reference to the accompanying drawings.

DETAILED DESCRIPTION OF THE PREFERRED EMBODIMENT

Figure 1:
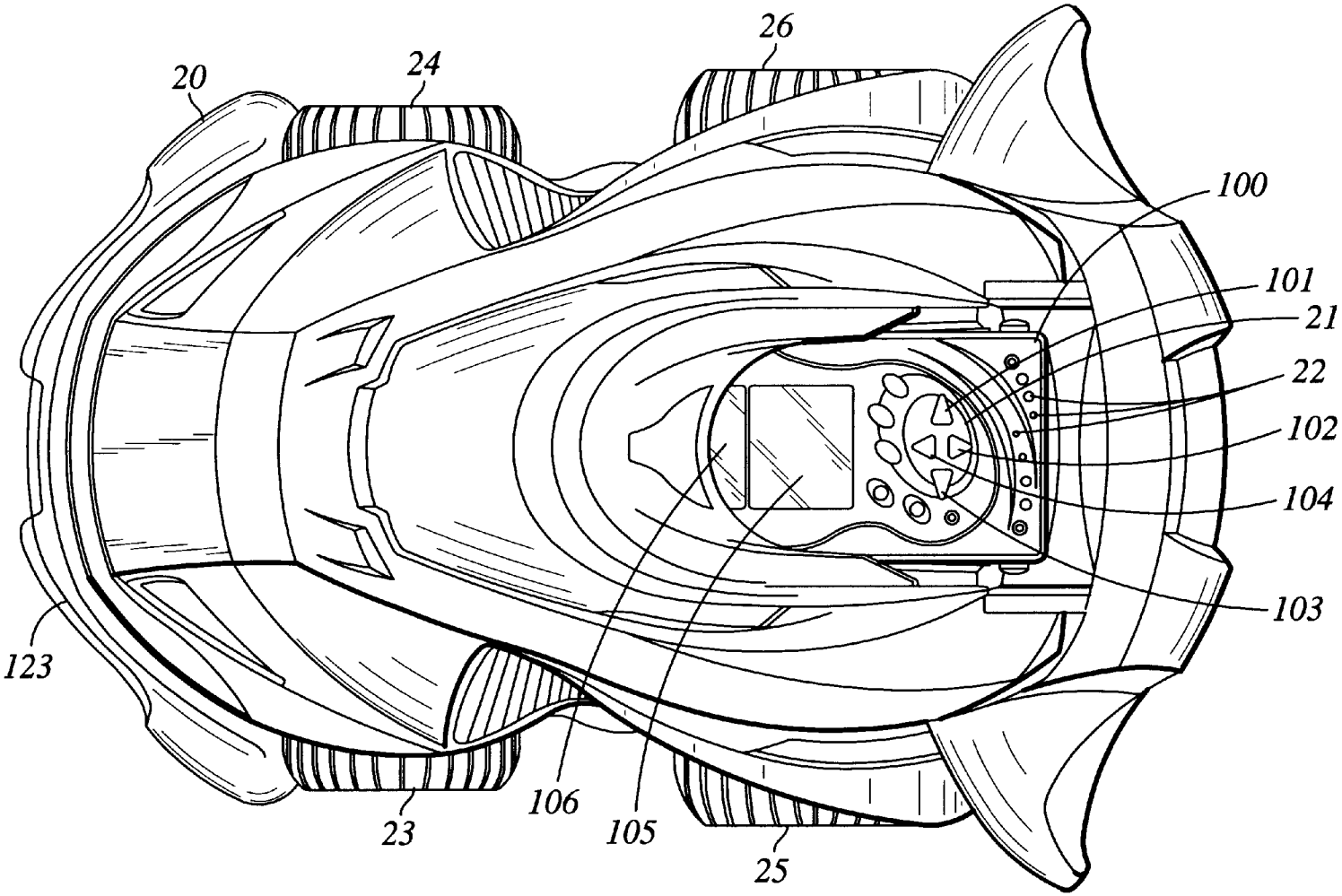
FIG. 1 is a top view of a first embodiment of the invention, namely a car.
Figure 2:
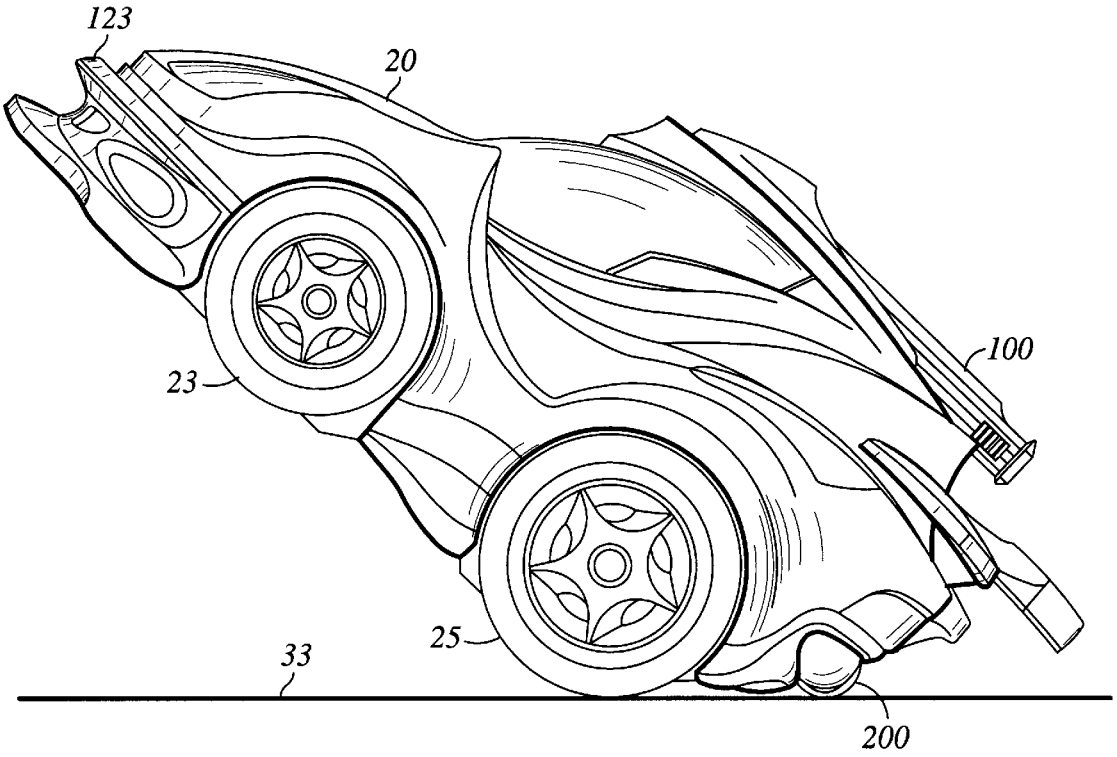
FIG. 2 is a side view of the car, in a pop-wheely position.
Figure 3:
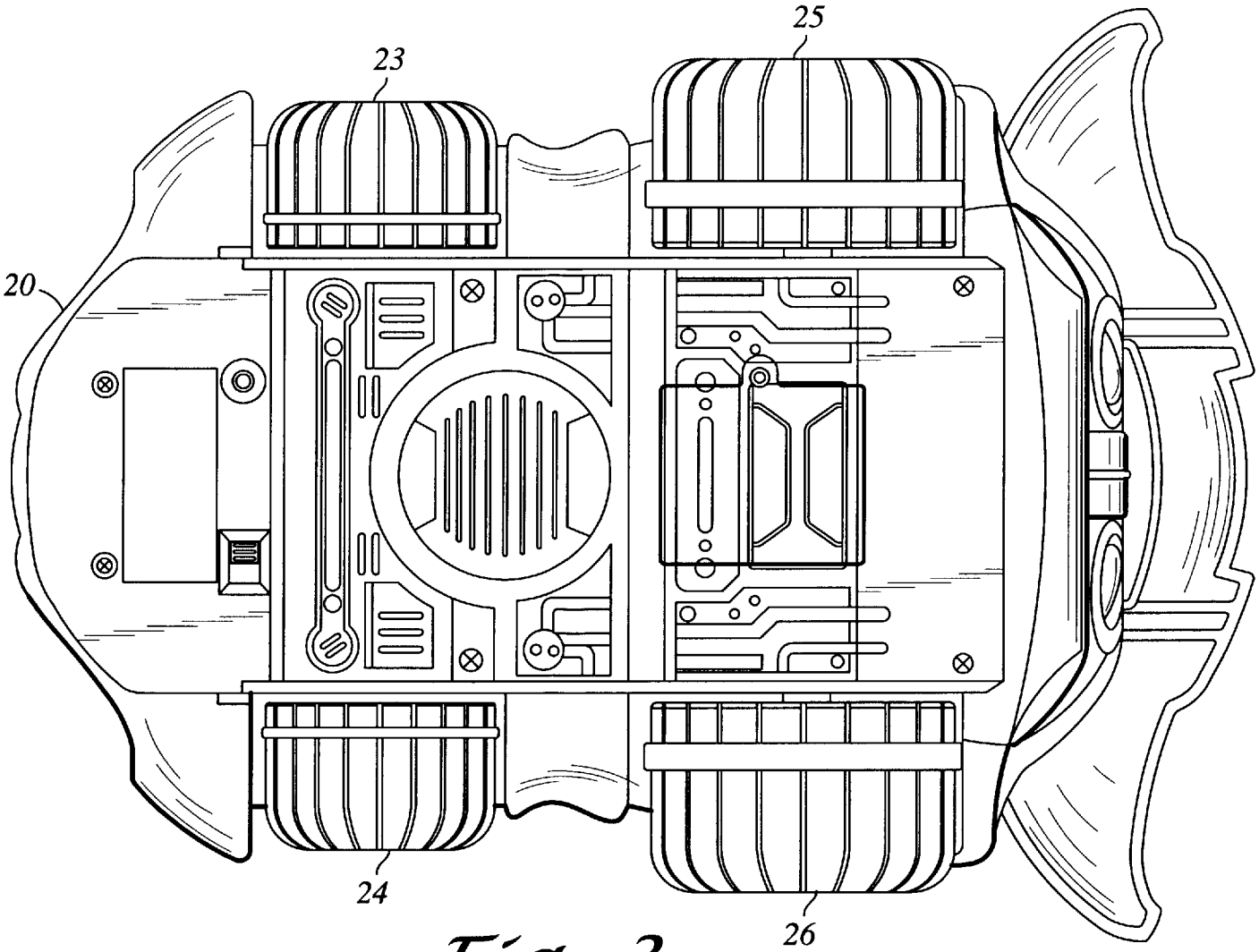
FIG. 3 is a bottom view of the car.
Figure 4:
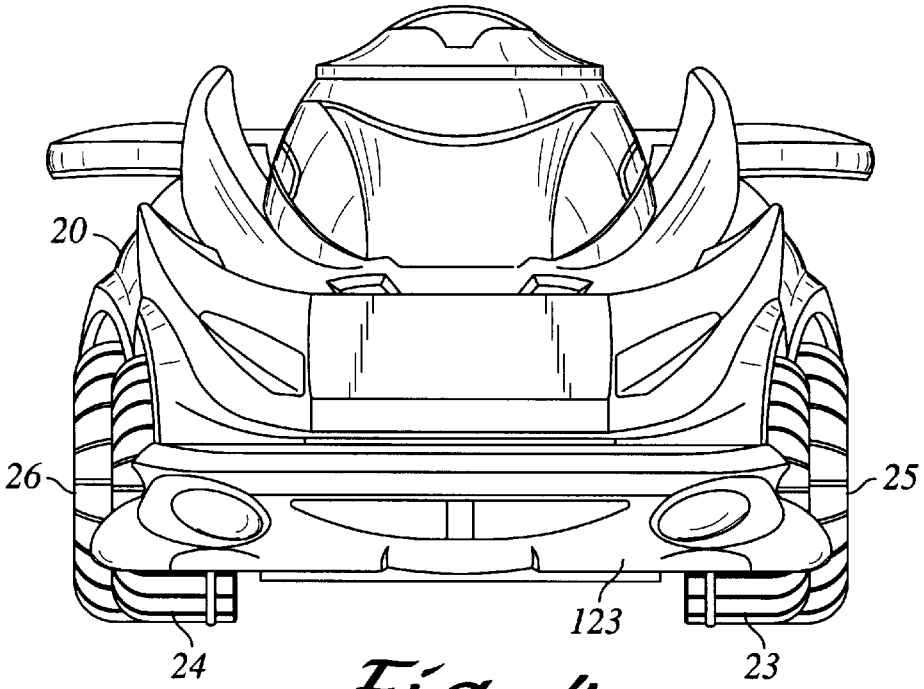
FIG. 4 is a front view of the car.
Figure 5:
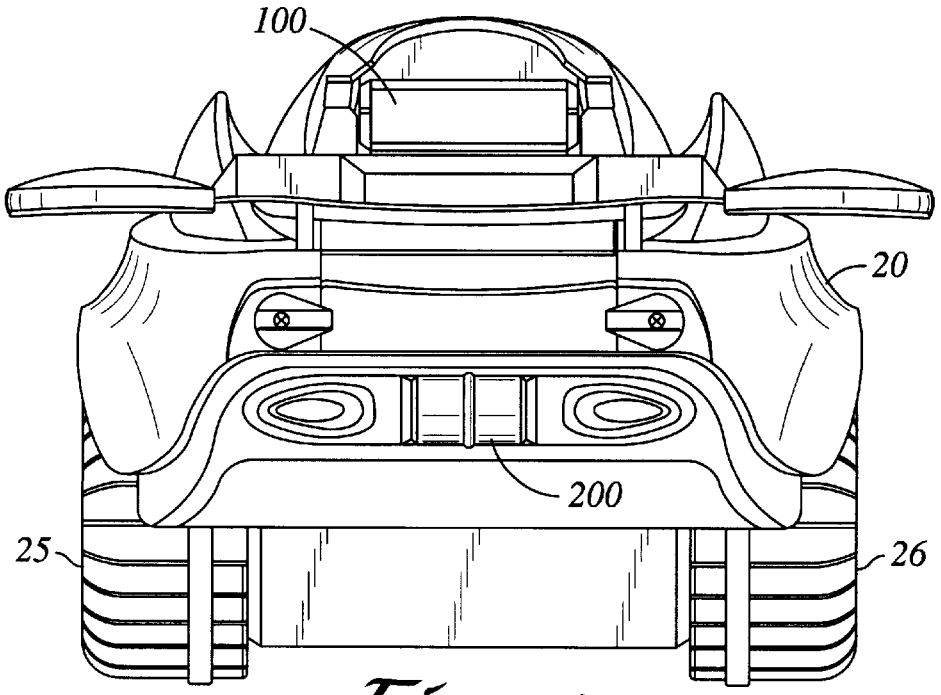
FIG. 5 is a rear view of the car.
Figure 6:
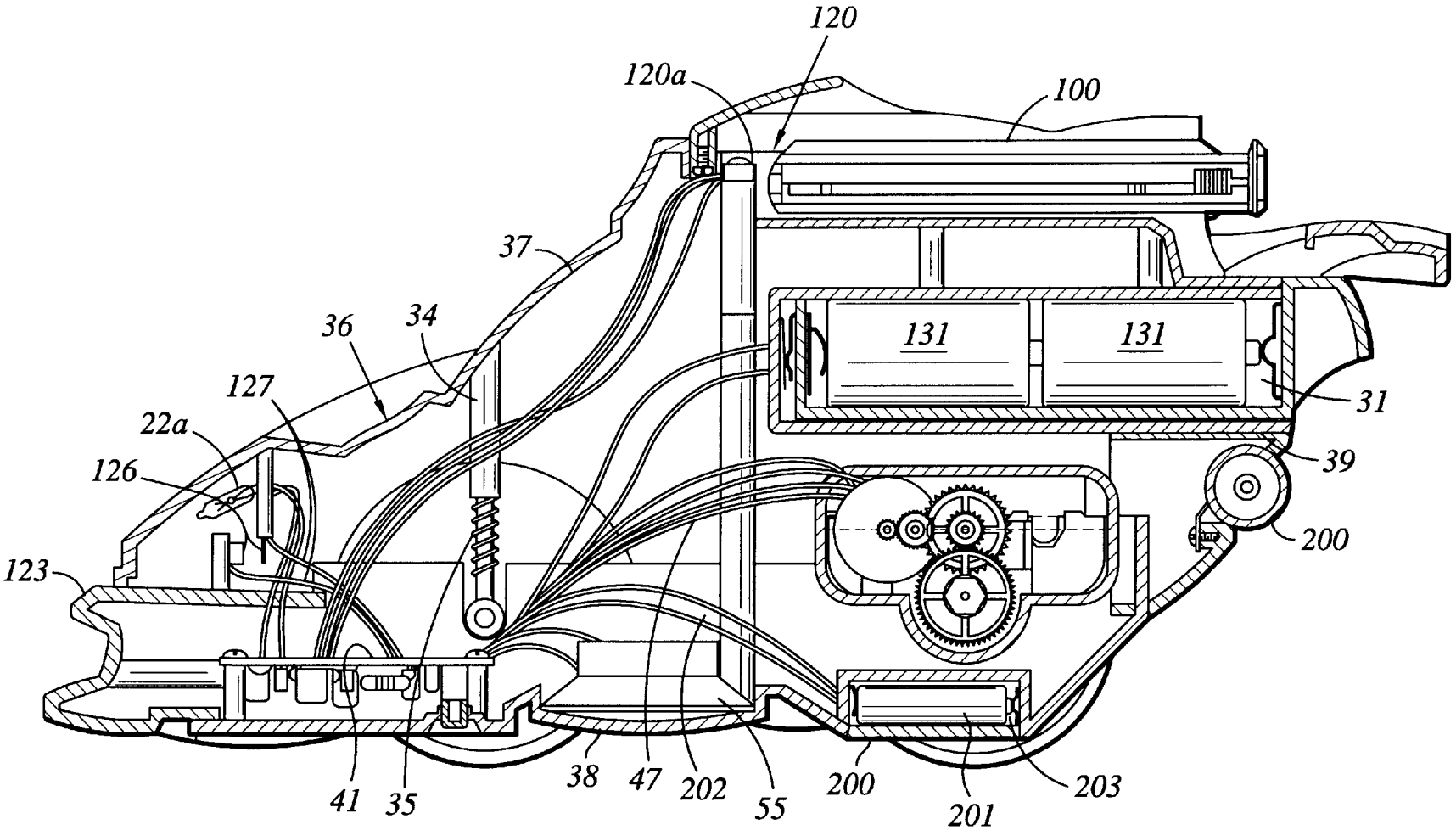
FIG. 6 is a sectional side view of the car showing the various mechanisms for driving the car and the electronic control system.
Figure 7:
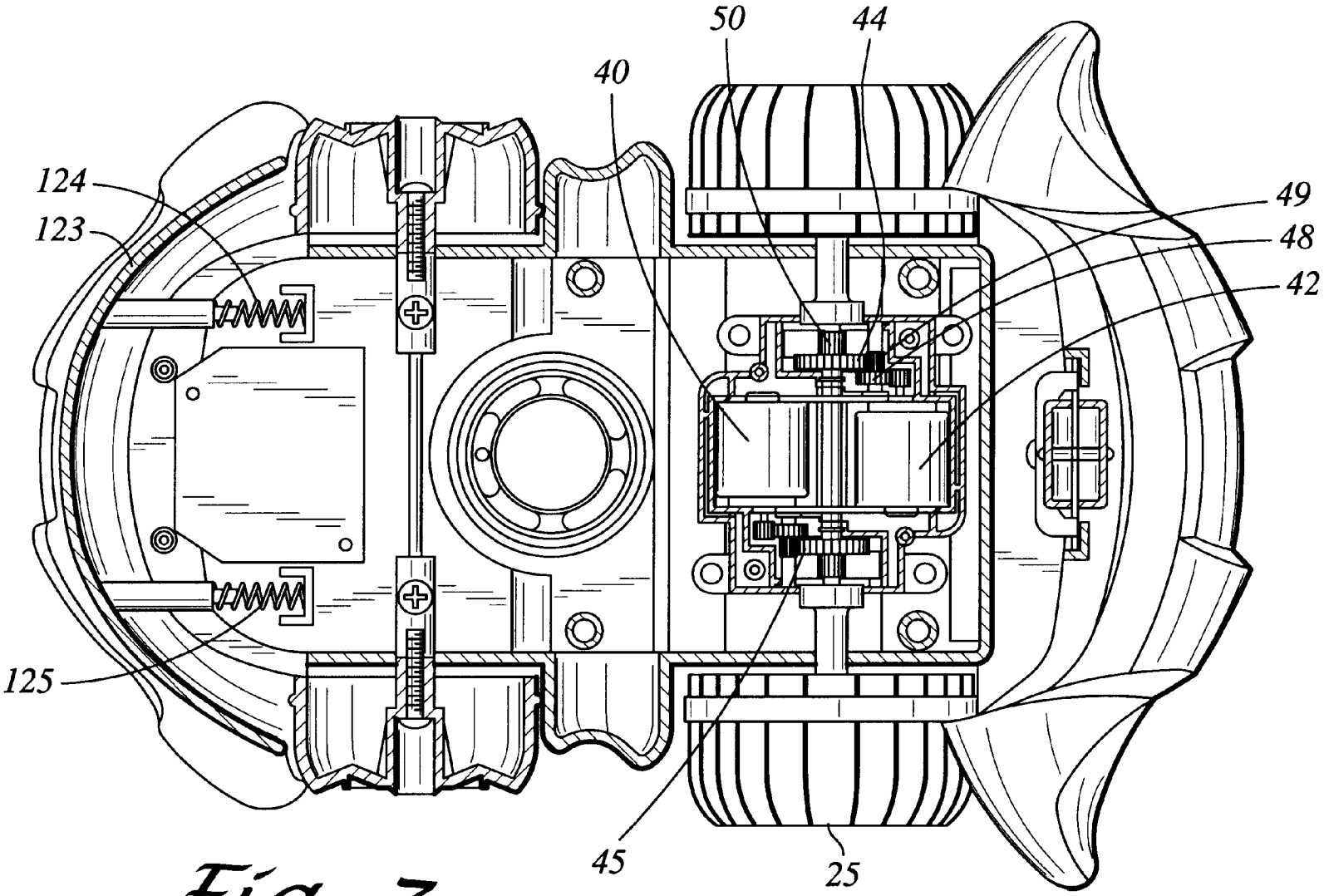
FIG. 7 is a sectional top view of the car showing the drive motor for driving the rear wheels of the car.
Figure 8A:
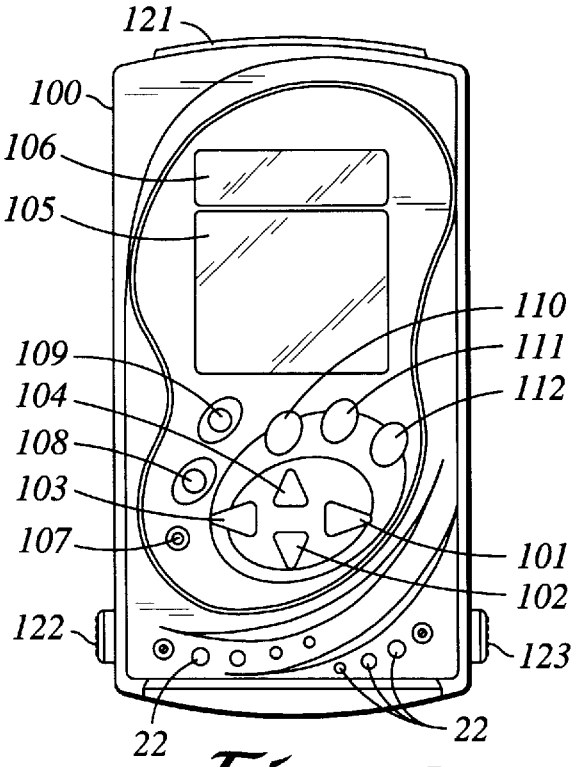
FIG. 8A is a top view of a game cartridge for the invention.
Figure 8B:
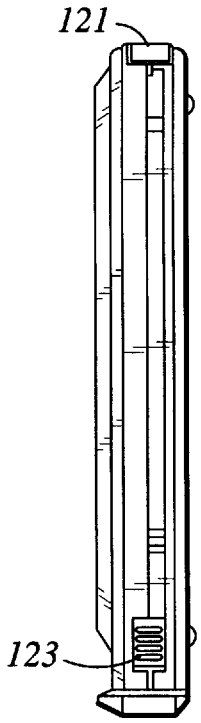
FIG. 8B is side view of the game cartridge.
Figure 8C:
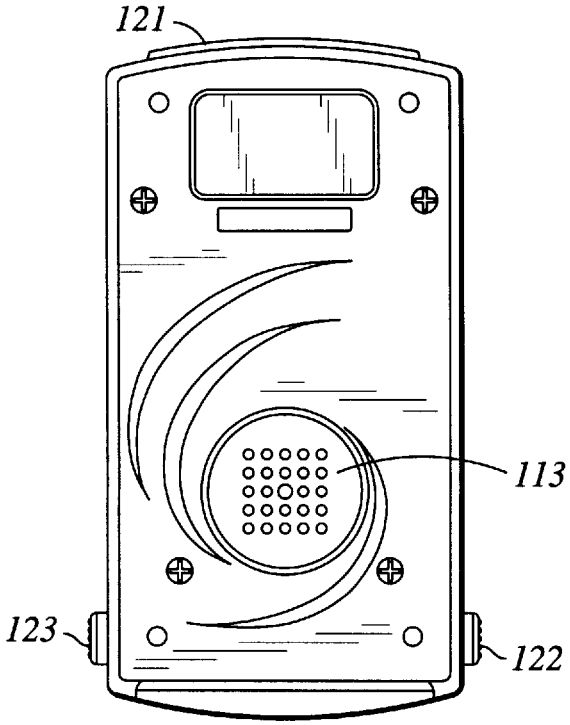
FIG. 8C is a bottom view of the game cartridge.
Figure 8D:
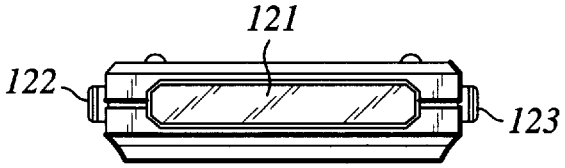
FIG. 8D is a front view of the game cartridge.

The invention is illustrated in relation to a car. It could be operational on other vehicles, for instance, van, scout and chaser vehicles.

A programmable and infrared controlled toy which includes two parts is provided. One part is a hand-held electronic cartridge with a programmable feature and the other is a motorized vehicle which responds to the programmed signals from the cartridge.

The removable multi-functional programmable cartridge includes an LCD display, microprocessor and infrared remote control device. It can be snapped easily into the vehicle. By pressing the appropriated keypad buttons the user can program the object to perform a series of preset actions.

In a first mode, the cartridge can be used either in a plugged or infrared communicating fashion to on-line instruct the vehicle or by infrared communication to move directly under remote control. Additionally, in a second mode, detached from the vehicle, the cartridge can act as a novelty game with multi-level progressive games which are self-contained. The game is associated with the vehicle driving. The cartridge is also operable as a clock with an alarm function.

The other part is a vehicle with a built-in infrared signal receiver. The receiver includes a circuit that translates the signal from the removable control unit, namely the cartridge, and the vehicle reacts in the actions, light and sound effect according to the command set by a user. The vehicle includes the integrated circuit chips that are responsive to the different keys to drive such a programmable system. Sound effects are developed by the IC in an integrated form which regulates the nature and level of the realistic sound effects. Real working headlights operate synchronization with the programmed actions. A bumper sensor reverses the vehicle direction if anything is in the way of the vehicle.

A vehicle 20 is shown with an independent cartridge 100 housing a keyboard 21 mounted on the top of the vehicle 20. There are four keyboard activated switches 101, 102, 103 and 104 in the cartridge 100. There are also graphic indicators 22 located on the rear of the keyboard 21 of the cartridge 100, and an LCD display with two portions 105 and 106 respectively on the front of the cartridge 100.

There are four spaced wheels, namely, front wheels 23 and 24 in the front of the vehicle 20 and rear wheels 25 and 26 in the rear of the vehicle 20. Wheels 25 and 26 are each driven respectively by a motor in a manner that will be described more fully below.

The rear of the vehicle includes a battery compartment 31 into which several batteries 131 can be located. The battery compartment 31 can be opened through a door switch or lock, which is appropriately turned to provide access or closure to the battery compartment 31.

The operation of the vehicle 20 is such that it can move on the surface 33 in a forward, rearward, left turn, right turn, rotational, or sinusoidal zigzag direction with slower or faster speeds as programmed into the vehicle 20. The vehicle can also vibrate under the action of the microprocessor on one or both of the motors or do a pop-wheely, namely tip up on the rear. At the rear of the vehicle 20 there is a roller 200 which is used to support the vehicle 20 in the pop-wheely position.

The front wheels 23 and 24 are mounted on a suspension mechanism 34 with a suitable helical spring 35. The shell of the body is shown as numeral 36, and can be cast as plastic having an upper portion 37, which can be screw connected with a lower portion 38. Within the molded plastic components, there are support elements which can form the structure of the internal workings of the car. This includes a floor 39 for the battery compartment 31.

Also, part of the vehicle action is a bumper 123 which is mounted relative to the chassis with two spaced helical spring configurations 124 and 125 respectively. Should the vehicle 20 bump into an obstacle, this is signaled through a sensor 126, and conductors 127 back to the control board 41. This action and reaction can effect the vehicle motion and/or game played with the vehicle 20.

Two batteries 131 are shown in the battery compartment 31. Mounted ahead of the battery compartment 31, there is a circuit board 41 which has in part the control circuit to drive motors 40 and 42 respectively. Motor 42 is operational through a gear wheel mechanism 44 to operate the wheel 26. The motor 40 is operational through a gear wheel mechanism 45 to operate the wheel 25. Power from the control board 41 is directed through a series of conducting cables 47 to the motors 40 and 42. Gear mechanism 44 includes at least three interlocking gears 48, 49, and 50, which activate the wheel 26. A similar gear wheel mechanism 45 and interlocking gears is applicable for wheel 25.

There is also a second battery compartment 203 and a battery 201 which is connected through wires 202 to the circuit board 41 and is for powering the receiver 120*a* in the vehicle and also the circuit 41.

Figure 9A:
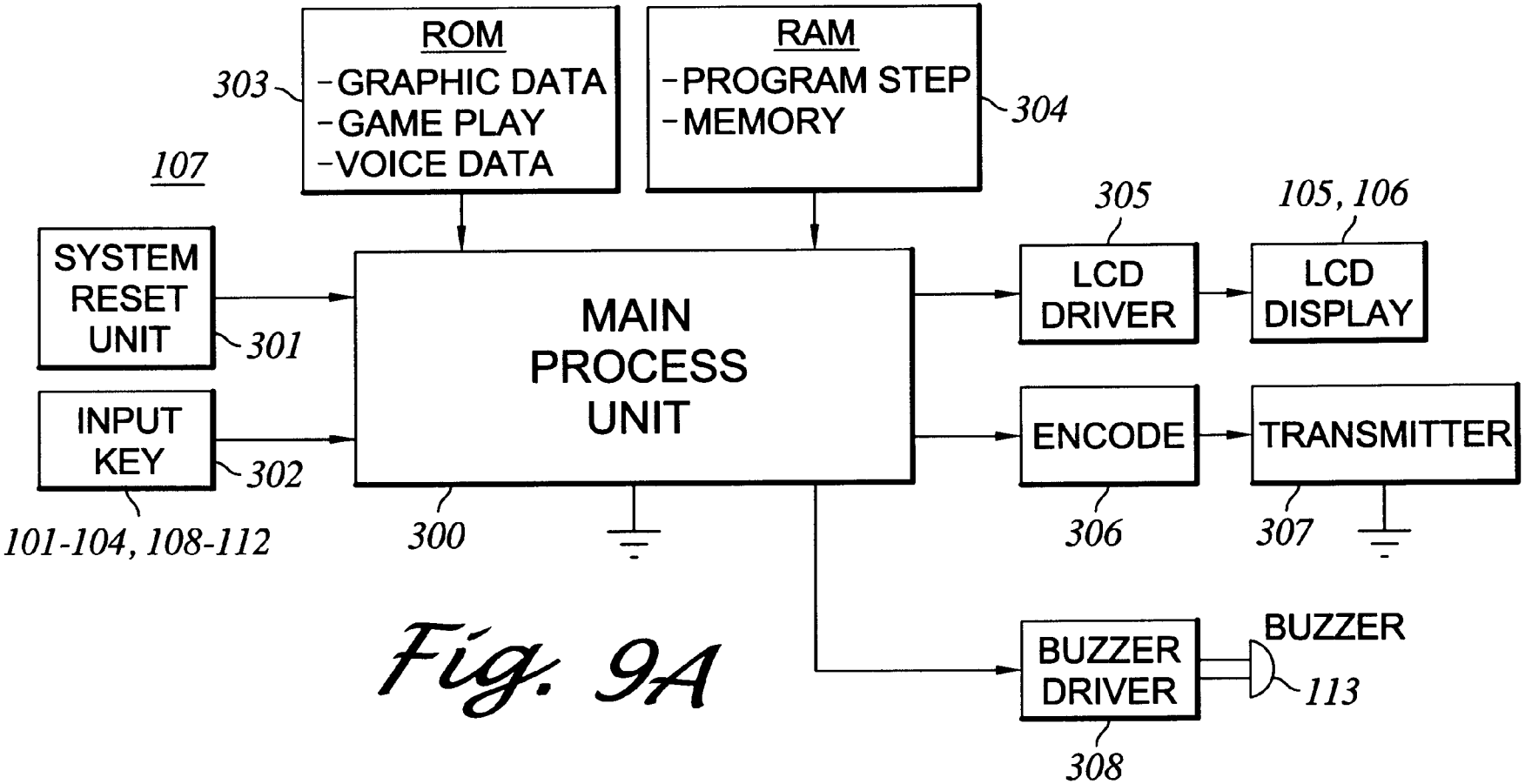
FIG. 9A is a circuit block diagram illustrating the main components of the control units and the microprocessor main control unit for both the first mode and the second mode of operation of the transmitter.

In FIG. 9A there is a transmitter circuit which is contained in the cartridge 100. There is a main process unit 300. There is the system reset unit 301, which receives signals from a reset key 107 on the cartridge 100. The input keys are represented by a block 302. The keys would be on the cartridge and are designated as 101 to 104 and 108 to 112. These keys signal the main process unit or microprocessor 300 as appropriate. There is also a ROM 303, which has the graphic data, game play and voice or sound data preprogrammed into it. A RAM 304 is provided with memory and different program steps. The ROM 303 and RAM 304 are connected with the main process unit 300, and interacts appropriately with unit 300 in response to signals from the reset unit 301 and input key 302. The main process unit 300 drives the LCD driver 305, which in turn drives the LCD display indicated by portions 105 and/or 106. The main process unit 300 also provides signals to an Encode circuit 306, which in turn operates an IR transmitter 307 which is at the output window 121 at the end of the cartridge 100. The main process unit 300 also operates a buzzer driver 308, which in turn operates a buzzer or speaker 113 which is mounted in the body of the cartridge 100.

Figure 9B:
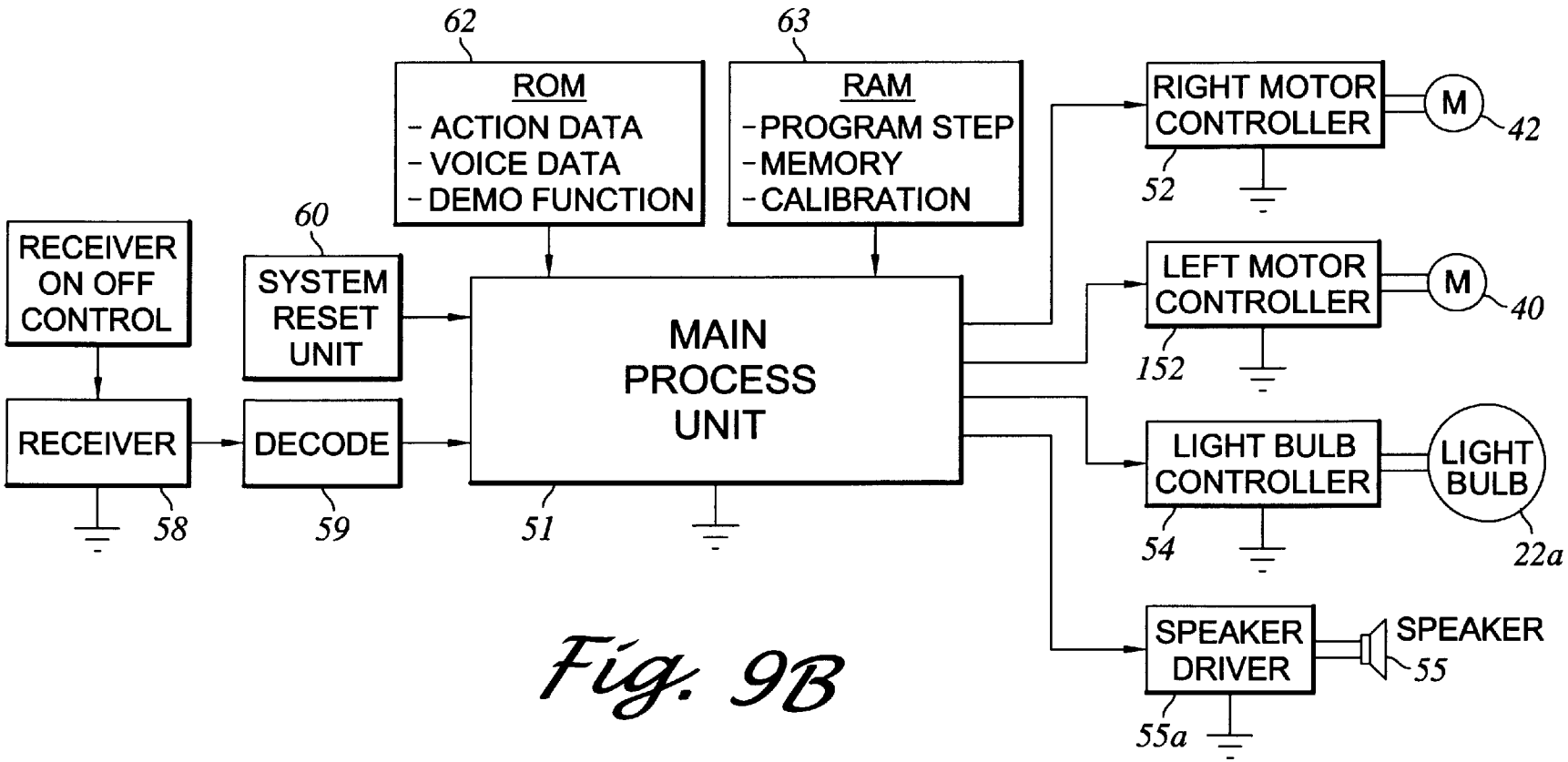
FIG. 9B is a circuit block diagram illustrating the main components of the control units and the microprocessor main control unit for both the first mode and the second mode of operation of the receiver.

In FIG. 9B, there is shown a main control process unit or microprocessor 51 of the receiver which is contained in the cartridge 100 and which is plugged into a slot 120 the top of the body of the vehicle 20. As such, the microprocessor in process unit 51 is connected for operating a right wheel 26, motor 42, and drive control unit 52 and also a left wheel 25, motor 40 and control unit 152. The drivers 52 and 152 are part of the circuit board 41 in the body of the vehicle 20.

The input from the keyboard 21 on the cartridge 100 is directed to the microprocessor main control unit 51. The keyboard switches 101 to 104 are press button elements which close circuits in the keyboard configuration 21 as shown. The microprocess unit 51 is a microprocessor which also controls a light source driver control unit 54 for operating the vehicle lights 22*a*, which is operational under given programmed conditions of the process unit 51. There is also a speaker 55 which is operational through the speaker driver 55*a* under the control of the microprocessor 51.

The receiver 58 to operate the decode module 59 and in turn the microprocessor main process unit 51. There is a ROM 62 for activation with the process unit 51. The ROM has designated Action Data, Voice Data and Demo Functions. There is also a RAM 63 with a program, memory and calibration program for interaction with the process unit 51 for inputting different amounts of time for each selected action. The process unit 51 also signals an LCD driver 59 which would operate an LCD unit with two display portions 105 and 106. A system reset unit 60 is also provided to signal the process unit 51. Power for the process unit 51 in the cartridge 100 is obtained from two batteries 131 which are connected to the processor unit 51.

The light bulbs 22*a* can be on the body as shown. The speaker 55 is mounted in the base of the vehicle 20. There can be additional sound generation in the cartridge 100, as shown by the holes in the body of the cartridge 100 for sound outlet from a speaker 113. There are two finger pads 122 and 123 at the rear of the cartridge 100. These pads 122 and 123 facilitate the insertion and removal of the cartridge from the body 20.

The control circuit and microprocessor would use, for instance, transistor pairs for the driver circuits. The microprocessor 51 would have multiple inputs and outputs. The inputs come from the key pad input on the cartridge 100, and the outputs are driven by the microprocessor 51.

With a hand-held electronic cartridge 100 with LCD display portions 105 and 106, it is possible to operate the programmable toy vehicle 20 with a series of preset action complemented with special light and sound effects. By pressing the appropriated keypad buttons 21 on the cartridge 100 the user programs the "likely to happen" environment and events animation on the LCD screen 105. The forward end 121 of cartridge 100 contains an infrared output which is receivable by receiver port 120*a* on the vehicle 20. The vehicle 20 can react in motion, light and sound effect. This enables a realization of the vehicle 20 in a real atmosphere.

The toy vehicle 20 plays or moves on a surface 33. The cartridge 100 can also be an independent game, preferably, related to the nature of the toy vehicle. The cartridge 100 itself is the control center for the vehicle 20 when plugged into the vehicle and it can also be played separately. Some games on the electronic cartridge are related to vehicles and are built into the microprocessor chip 51.

The independent games played with the cartridge 100 games are divided into several parts including normal driving and racing. By normal driving and racing and playing games the player earns game scores which are reflected in the LCD screen portion 105. When the player accumulates a sufficient score, the player can increase the level of skill by raising the difficulty of the race.

The invented product includes several components:

(a) A cartridge 100—with LCD an display having two separate portions 105 and 106 to control the action of one or more related vehicles 20 and provide independent games.

(b) A vehicle 20—which receives signals from the cartridge 100 and reacts accordingly on a surface, or generates sounds, or light.

The cartridge 100 includes 10 function keys which are:

4 Control Keys: Right, Down, Left, and Up (101 to 104 respectively). 1 Reset Key 107, 1 Memory Key 108, 1 Demo Key 109, 1 Go/Start Key 110, 1 Mode Key 111, and 1 Enter Key 112. There are LCD display portions 105 and 106 on the cartridge, 100. The size of the cartridge is approximately 37 mm×44.5 mm. The cartridge also includes a buzzer or speaker 113.

When the cartridge 100 is turned on, the LCD display screen portion 106 shows an operation menu. Firstly, the player completes the "Setting" and then use the "mode" key to select other functions and games. Appropriate animation and sound effects accompany each input. The LCD screen portion 106 also incorporates a clock and alarm feature, and shows the different game modes and programmed vehicle actions as illustrated further in FIG. 10B. Different animations are generated according to different commands.

After selection, the relevant details are displayed on the LCD display screen portions 105 or 106. The player follows the key-in steps to activate the command. Different animation and sound effect accompany each command. On-line control function, namely when operating in the first mode, provides "Right", "Down", "Turn Left Forward" & "Turn Right Forward" functions. Off-line function, namely when operating in the second mode, provides "Setting" mode, "Programmable Drive" mode, "Alarm Drive" mode functions. The cartridge need not be plugged into the vehicle for the Off-line modes.

Operation Menu

There are a total of five main manual modes:

Setting Mode

Programmable Drive Mode

On Line Drive Mode

Game Mode

Alarm Set Mode

Setting

There are five different functions to allow adjustment on the status of:

| | |
|---|---|
| Time: | preset/reset default to be 12:00<br>adjust the local time |
| Head Light: | preset/reset default to be off<br>set headlight to be on or off accompany with the programmed actions |
| Self-Calibrations | preset/reset default to 0<br>+/− 15 steps to adjust the alignment of the desired run by programming in the command |
| Sound Effect | preset/reset default to be with sound<br>set with or without the realistic sound effects accompany with the programmed actions |
| Bumper | preset/reset default to be functional<br>the bumper sensor reacts by reversing direction of the vehicle if anything in the way |

Programmable Drive Mode (First Mode)

There are more than 20 different motions or actions which can be effected by the vehicle 20.

| | |
|---|---|
| Forward | Turbo Forward |
| Backward | Turbo Backward |
| Turn Left | Turn Right |
| Turn Left Crossing Obstacle | Turn Right Crossing Obstacle |
| Pop Wheelies | Shaking |
| Makes "8" Turn | Sine Curve Forward |
| Rotate | Turbo Rotate |
| Turn Left By Radius | Turn Right By Radius |
| Headlight | Pause |
| Vibration | Back to Start |

By pressing the four control keys 101 to 104, these actions can also be adjusted in distance, time and direction. The system allows the player to store a self designed program for up to a sequence of maximum 32 steps. "Demo" or "Memory" mode can be input and counted as 1 step. Appropriate animation and sound effect accompany each input. The selected action plays after pressing "Go" key. The last step or the whole sequence of the current program can be deleted by using "Edit" key. It is also possible to add a step into the last program by using "Add-in" key. If the vehicle finishes the appointed route without bumping into the obstacles, it achieves the highest scores. The scores are be deducted for any bumping. In this first mode operation of the toy there is also a scoring which can be achieved. The format of scoring is optional.

On Line Drive Mode (First Mode)

The remote control system is infrared and can be used to instruct the vehicle to perform associated actions. By pressing the four control keys on the control unit to activate the vehicle to move Forward, Backward, Left and Right directly. Sound effect and working headlights will accompany the wild driving.

Alarm Set Mode (First Mode)

Reset/reset default to be no alarm function

Three different alarm status can be preset:

Alarm only

Alarm with action (action can be chosen among the preset action in Demo or Memory mode)

Preset wake-up call (vehicle runs forward until it bumps into an object, then moves backward for two seconds, repeat until pressing the "Go/Start" button)

Only the vehicle will present the alarm and action.

Game Mode (Second Mode)

The keyboard on the cartridge can be independently used to play the following two games:

Cross The Road Game (Second Mode)

This game is independent of the vehicle. The player has to pass the obstacles and reach the end. There are five levels to select. The obstacles are preset with different speed and direction in different levels.

Racing Game (Second Mode)

There are three different tracks for selection. The player has to drive and finish the route according to the track without bumping the opponent car. This game can relate to the vehicle, and the vehicle can run the same actions resulting from the game play if the player selects "Replay".

Demo (First Mode)

With built in memory, just press "Demo" key in any mode and the vehicle performs any of six different preset actions with sound effects.

Memory (First and Second Modes)

A save and memory feature allows for a single or multiple repeat of a previously programmed run.

| | |
|---|---|
| Save Memory | It allows the player to save the predetermined or determined instructions up to thirty two steps of action in a sequence.<br>The input could be retrieved, edited or deleted at any time.<br>Any new data saved replaces the existing program. |
| View Memory | View the existing input. |
| Play Memory | Play the existing input. |

Screen Saver (First and Second Modes)

No matter what mode the user is in, after five minutes of inactivity, screen saver replaces the normal animation on display. After thirty minutes, it will go to sleep mode and will not have animation and display. If the player presses the key, then the last animation will be on the screen.

Figure 10A:
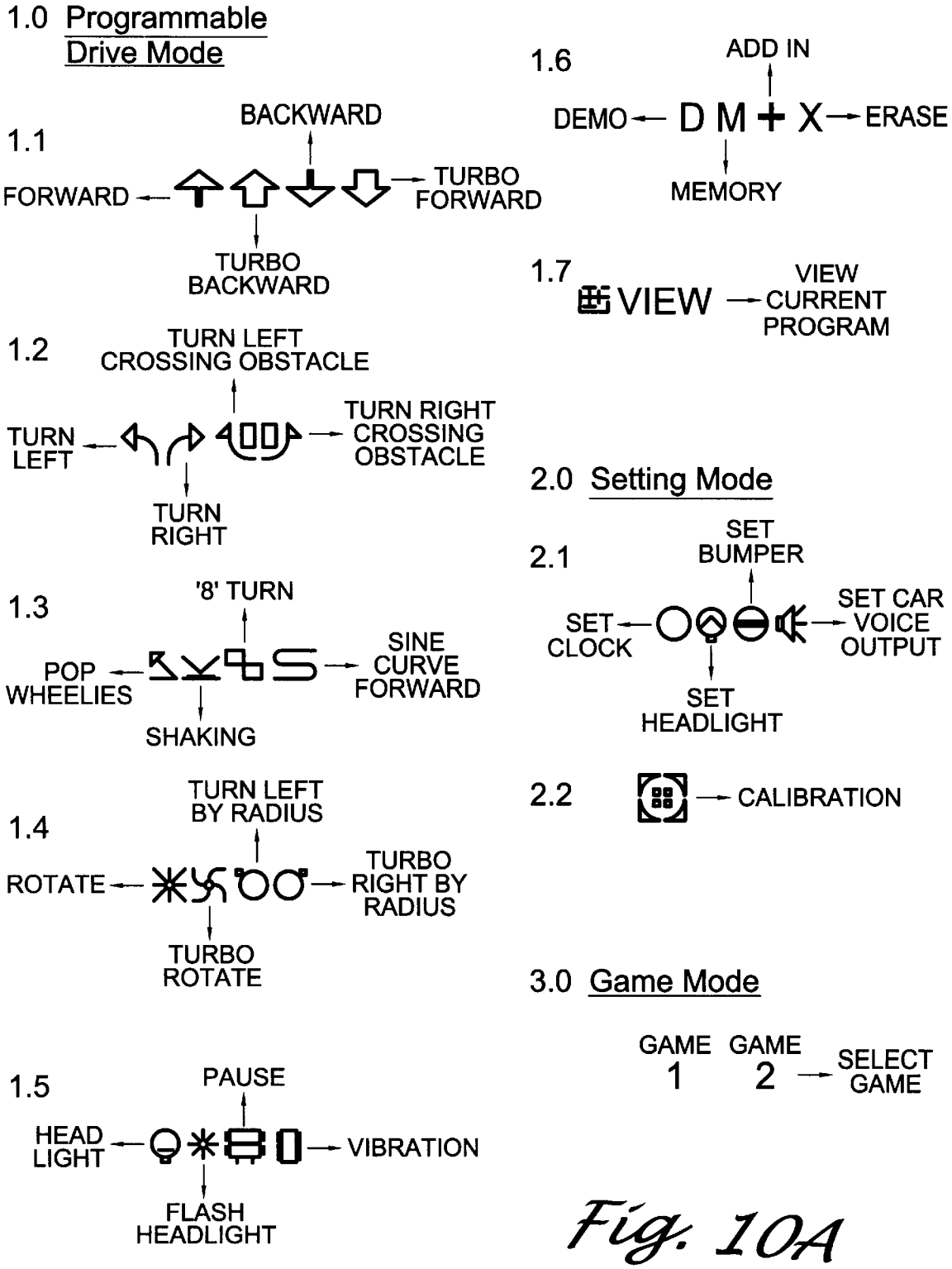
FIG. 10A is a schematic illustrating different icons on a display on the cartridge representative, firstly, of different modes of operation of the car with the removable cartridge in place in the car, and, secondly, of games using the game cartridge in an independent state separated from the car.
Figure 10B:
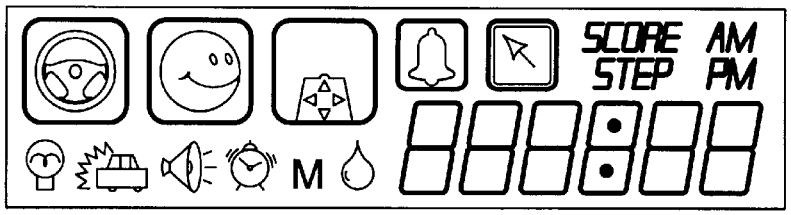
FIG. 10B is a representation of different icons which are on the display of the cartridge.

In FIGS. 10A and 10B, different displayed icons are illustrated. There are icons representing a normal drive status. These icons are represented on an LCD display 107. In FIG. 10*a* the different motions of the vehicle are shown in the various displays 1.1, 1.2, 1.3, 1.4 and 1.5. The display in 1.6 represents the demo, memory, add-in and erase modes. Display 1.7 illustrates the new mode. By programming the various motions and actions of the vehicle 20 into the microprocessor 51, when the cartridge 100 is inserted into the body, the vehicle 20 follows these actions.

The icons represented under display 2 represent different characteristics of operation and timing. Display 2.1 relates to timing, calibration and sound adjustment level. Display 2.2 relates to the calibration alarm settings, battery change and distance measurement.

Icons in display 3 relate to the game mode.

In FIG. 10B there is shown icons which would be represented in the LCD display portion 106. There is shown the Main Manual icons with the different representations of the Programmable Drive Mode, Game Mode, On-line Drive Mode, Alarm set Mode and Setting Mode. There is also illustrated the Status icons, which respectively are the Light Bulb-on, Bumper-on, Speaker, Car-on, Alarm-on, the Memory and the Fuel levels. For the game purposes there are also shown the icons which have the score and the step icon for the clock and/or alarm clock function. There is an a.m./p.m. setting and also an alphanumeric display for score and/or time.

Figure 11:
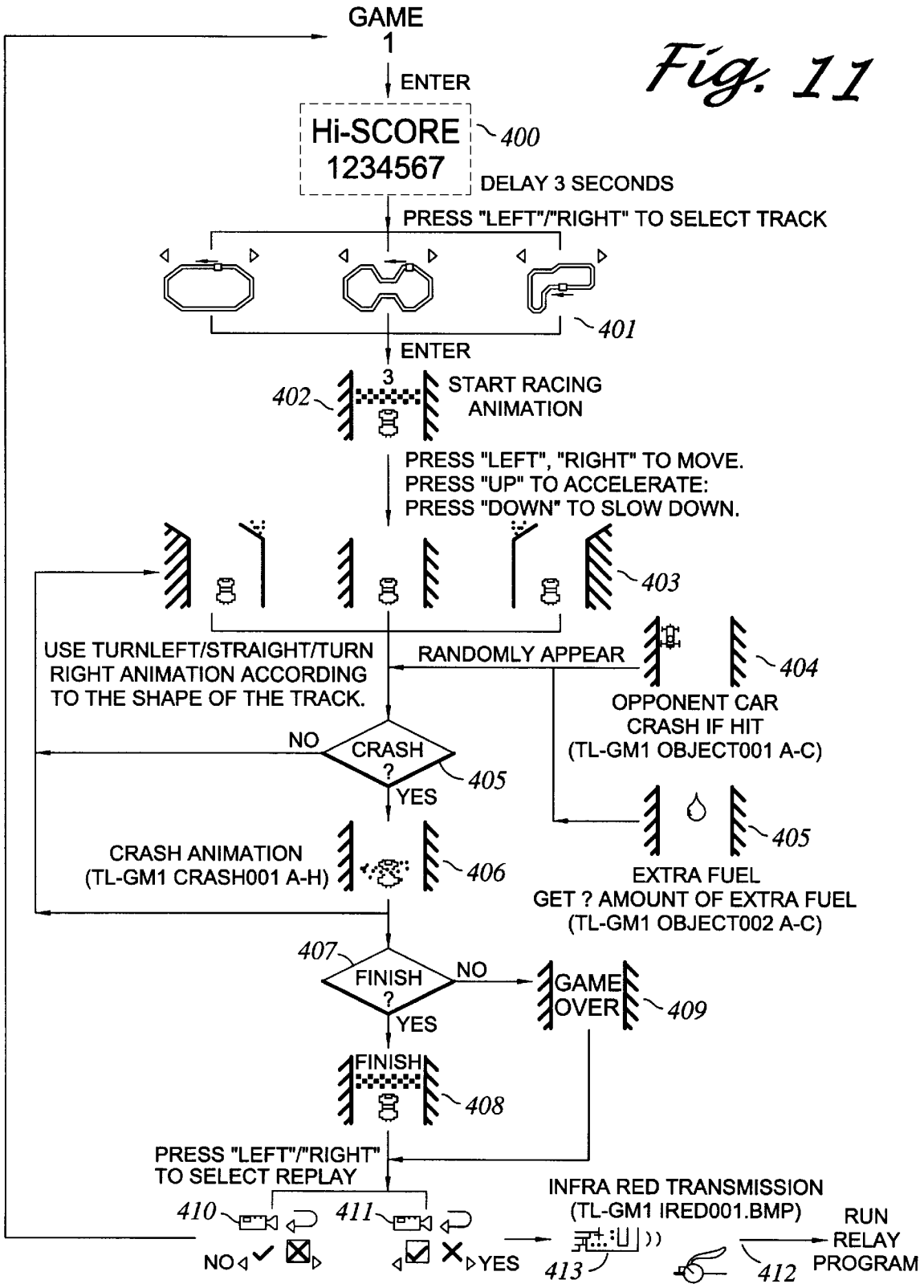
FIG. 11 is a flow diagram illustrating a game being played on the cartridge.

In FIG. 11 there is shown the configuration for a representative game. The flow diagram shows the procedure.

There is a score representation which is illustrated in block 400, and which would be displayed in the LCD display portion 106. In the LCD display portion 105 there is a display 401, which enables the selection of a particular track. After this track is selected, the display portion 105 starts a racing animation sequence as illustrated in the block 402. By pressing various keys 101 to 104, the vehicle illustrated can move down the track as appropriate, and this is illustrated in block 403. As set up in the preprogrammed game, there can be events which are associated with the game. For instance, in block 404 there is an opponent car which is illustrated, and this can randomly appear in the display 105. The player can be involved in a crash as indicated in the block 405. If there is such a crash, there can be a crash animation as indicated in block 406. If there is no crash, the cycle can return to the screen 403 and scoring can continue.

An alternative configuration is where the driver needs more fuel as indicated in block 405, and this can be interacted in the game as indicated by the different flow lines. At an appropriate time, the finish position is reaches as is indicated in block 407, and the finish point can be reached as illustrated by block 408, which would be displayed in the LCD portion 105. Likewise, the game over condition is indicated by 409 would be displayed. A replay is possible as indicated by the ability to press different keys as figuratively illustrated by blocks 410 and 411 on the cartridge. Block 410 would result in no replay, and block 411 would result in a replay. Thereafter, the replay is possible as indicated along line 412, which would send instructions to the main process unit 300 to run the replay program. Also illustrated in FIG. 11 is an icon 413, which is representative of the infrared transmission through window 121.

General

Although the invention has been described with reference to a four-wheeled automobile vehicle, it is clear that the invention also has application to other devices such as different toys or novelty items. The kind of toys could be a ship, plane, robot, different kinds of automobile such as a three-wheeler, or a motor bike. The surrounding environment would be appropriately a surface, or could be the water in the case of a ship, or air in the case of a plane. In the case of a ship, boat, or plane, the motive generator can be a propeller or screw device. In some situations, the programming can be effected remotely and be communicated by radio or infrared control. Thus the cartridge can be physically connected with the body or in a non-physical connection with the body. Different games can be played. Other than a racing game, there can be a game of transversing or crossing the road on which vehicles travel.

The invention is to be determined in terms of the following claims.

We claim:

1. A programmable device comprising:

a body;

a motor for activating a motive generator on the body for causing the body to move relative to a surrounding environment;

a cartridge having a keypad including a series of control switches for operation by a user, the cartridge being selectively removable from the body; and the switches being connected with a microprocessor for translating signals received from the switches selectively, in a first mode when the cartridge communicates with the body, into control signals for operating the motor whereby the body is caused to move in different directions according to the action of the motor on the motive generator; or in a second mode when the cartridge is removed from the body, into signals for engaging a game related to a program in the cartridge, the game being operable by activating the keypad to operate the switches, and the switches cooperating with the program.

2. A device as claimed in claim 1 wherein the motive generator is at least one wheel and the body is representative of a vehicle.

3. A device as claimed in claim 1 wherein the cartridge includes a the series of display elements, the display elements being reactive with the switches to indicate a selected program of motion for the motive means, or a game program, and indicate stages of the game.

4. A device as claimed in claim 3 wherein the display elements include lights or an LCD, the lights being selectively at least one LED, and wherein the display elements being for indicating the state of operation of the first mode or a state of operation of the second mode.

5. A device as claimed in claim 1 wherein the body is representative of an automobile vehicle and wherein there are four spaced wheels, and wherein two wheels are driven by the motive generator.

6. A device as claimed in claim 5 wherein the driven wheels are the rear wheels of the automobile vehicle.

7. A device as claimed in claim 1 wherein the microprocessor is programmable so as to permit for a selection of motions including at least one or multiple motions of forward, backward, left turn, right turn or a circular direction.

8. A device as claimed in claim 6 including the motion of pop-wheeling, and wherein a center of gravity of the vehicle is located strategically relative to the wheels thereby to permit tipping of the vehicle according to the control of the wheel motion and thereby to permit pop-wheeling.

9. A device as claimed in claim 1 including a speaker for creating sounds, and means for selectively interacting with the motor of the motion generator thereby to create corresponding sounds from the speaker.

10. A device as claimed in claim 1 including a light in the body, the light being for reaction to the program.

11. A device as claimed in claim 1 wherein the body is a representation selectively of a boat, train, plane, automobile, robot or motor bike.

12. A device as claimed in claim 1 wherein, when the cartridge communicates with the body, the microprocessor in the cartridge is connected such that control means for operating the motor is enabled, and control means for operating a light in the body and a sound generator in the body are enabled, the sound generator being operable selectively according to a state of operation in the first mode.

13. A device as claimed in claim 1 wherein the keypad permits the user to select, through the microprocessor, at least one of a series of different games for operation in the second mode.

14. A device as claimed in claim 1 wherein the cartridge includes a display, the display including an LCD, and wherein the operation of the microprocessor acts to selectively operate the LCD.

15. A device as claimed in claim 1 wherein the cartridge includes a display and circuitry operably as a clock, and selectively an alarm clock.

16. A programmable toy vehicle and game comprising:

a body;

motor means for activating wheels on the body for causing the body to move on a surface;

a cartridge having a keypad located on the body including a series of control switches for operation by a user, the cartridge being selectively removable from the body;

a display on the cartridge; and the switches being connected with a microprocessor for translating signals received from the switches selectively, in a first mode when the cartridge communicates with the body, into control signals for operating the motor means whereby the body is caused to move in different directions on the surface according to the action of the motor means on the wheels, or in a second mode when the cartridge is removed from the body, into signals for engaging a game related to a program in the cartridge wherein the display on the cartridge react to selective operation of the switches, and the switches cooperating with the program.

17. A toy as claimed in claim 16 wherein the body is representative of an automobile vehicle and wherein there are four spaced wheels, and wherein each of two wheels is driven by a respective motor.

18. A toy as claimed in claim 17 wherein the microprocessor is programmable so as to permit for a selection of motions including at least one or multiple motions of forward, backward, left turn, right turn or a circular direction.

19. A device as claimed in claim 16 wherein the display includes a LCD for indicating the state of operation of the first mode or the state of operation of the second mode.

20. A device as claimed in claim 16 including a speaker for creating sounds, and means for selectively interacting with the motor means thereby to create corresponding sounds from the speaker.

21. A device as claimed in claim 17 including a light in the body, the light being for reaction to the program.

22. A toy as claimed in claim 16 including a speaker for creating sounds, and means for selectively interacting relative to activation of the wheels, thereby to create corresponding sounds from the speaker relative to vehicle motion.

23. A toy as claimed in claim 17 wherein when the cartridge is connected to the body, the microprocessor is connected to enable control means for operating the motor, and control means for enabling operating a light in the body and a speaker in the body.

24. A toy as claimed in claim 17 wherein the keypad permits the operation of multiple controls which is thereby to permit the selection of multiple combinations of motion of the body when the cartridge is connected with the body.

25. A programmable device comprising:

a body;

a motor for activating a motive generator with the body for causing the body to move relative to a surrounding environment;

a cartridge having a keypad including a series of switches for operation by a user, the cartridge being for selective operation with the body or for operation independently of the body;

visually responsive means on the cartridge; and the switches being connected with a microprocessor for translating signals received from the switches selectively, in a first mode when in an operative relationship with the body, into control signals for operating the motor whereby the body is caused to move in different directions according to the action of the motor on the motive generator; or in a second mode when independent of the body, into signals for engaging a game in the cartridge for operation with the visually responsive means in response to user action of the switches.

26. A device as claimed in claim 25 wherein the cartridge communicatingly operates with the body through a non-physical, preferably infrared, connection with the body.

27. A device as claimed in claim 16 wherein the cartridge includes a display and circuitry operably as a clock, and selectively an alarm clock.

28. A method of operating a programmable device comprising:

activating a motive generator in a body for causing the body to move relative to a surrounding environment;

operating a keypad on a cartridge to activate a series of control switches;

energizing selectively a display on the cartridge; and the switches being connected with a microprocessor for translating signals received from the switches selectively, in a first mode when the cartridge is communicatingly operable with the body, into control signals for operating the motive generator whereby the body is caused to move in different directions; or in a second mode when the cartridge is independent of the body, into signals for a game wherein the display on the cartridge reacts to selective operation of the switches and a program in the cartridge.

29. A method as claimed in claim 28 wherein the cartridge operates with the body by being physically connected with the body.

30. A method as claimed in claim 29 wherein the game relates to vehicle driving.

31. A method as claimed in claim 28 wherein the cartridge operates with the body by a non-physical connection with the body preferably, infrared remote control of the body.

32. A method as claimed in claim 31 wherein the game relates to vehicle driving.

* * * * *